US005246160A

United States Patent [19]

Jonas

[11] Patent Number: 5,246,160

[45] Date of Patent: Sep. 21, 1993

[54] METHOD FOR ROLL-BONDING OF HIGH-SPEED STEEL TO MILD STEEL, AND BAR PRODUCED THEREBY

[75] Inventor: Michel Jonas, Fourmies, France

[73] Assignee: Acieries et Forges d'Anor, Anor, France

[21] Appl. No.: 925,197

[22] Filed: Aug. 6, 1992

[30] Foreign Application Priority Data

Aug. 9, 1991 [FR] France ..... 91 10170

[51] Int. Cl.[5] ..... B23K 20/04

[52] U.S. Cl. ..... 228/186; 228/235; 228/263.15; 228/162; 76/104.1

[58] Field of Search ..... 419/8, 69; 228/186, 228/235, 243, 162, 263.15; 76/101.1, 104.1, 112

[56] References Cited

U.S. PATENT DOCUMENTS 2,686,439 8/1954 Tobert ..... 76/112
2,932,886 4/1960 Althouse ..... 228/186 X
3,228,103 1/1966 Shewmon ..... 228/186 X
3,593,600 7/1971 Adams et al. ..... 76/112
4,428,260 1/1984 Eby ..... 76/104.1
4,923,671 5/1990 Aslund ..... 419/8

FOREIGN PATENT DOCUMENTS 2190556 2/1974 France .
2391018 12/1978 France .
157720 7/1987 Japan ..... 76/25.1

*Primary Examiner*—Kenneth J. Ramsey
*Attorney, Agent, or Firm*—Young & Thompson

[57] ABSTRACT

A method of manufacture of a bar by roll-bonding of medium-alloy or high-alloy steel to mild steel involves the use of a tip composed of alloyed steel obtained by powder metallurgy, in which the compacting gangue of the tip has been retained so as to form a strong and intimate bond between the tip, the counter-tip, and the substrate.

6 Claims, 1 Drawing Sheet

METHOD FOR ROLL-BONDING OF HIGH-SPEED STEEL TO MILD STEEL, AND BAR PRODUCED THEREBY

BACKGROUND OF THE INVENTION

1. Field of the Invention

The present invention relates to a method for carrying out roll-bonding of medium-alloy or high-alloy steel to mild steel, which it has never been possible to achieve on an industrial scale up to the present time.

2. Description of the Prior Art

In the well-known roll-bonding process, a tip of high-grade and therefore expensive steel is applied by forging on a substrate of low-alloy and therefore inexpensive steel at a temperature of approximately 1150° C. This process leads to the production of bimetallic bars also known as tipped bars or bars of composite steel or else bars of clad steel.

This roll-bonding technique is employed at the present time mainly for the production of wearing flats such as rolling-mill slides, for example, or for the manufacture of tipped industrial blades and knives such as, for example, the blades of guillotine cutters for paper, of peeling machines or slicing machines for wood.

However, although roll-bonding achieves excellent results with low-alloy steel, it proves unsatisfactory for medium-alloy or high-alloy steel tips.

In the present description, it will be understood that low-alloy steel refers to grades of steel containing a maximum percentage of 2% of alloying elements such as silicon (Si), molybdenum (Mo), tungsten (W), vanadium (V) and/or chromium (Cr) such as, for example, the grades 80WC20, 110WC10, medium-alloy or high-alloy steels refer to grades of 90MCW5 or 60WC20. It will be understood that steel containing more than 2% of alloying elements such as, for example, Z160CDV12, or the so-called high-speed steels, type 18-0-1 or 6-5-2, which are a particular case of high-alloy steels.

The reason for which roll-bonding of medium-alloy or high-alloy steel with mild steel has not been adopted on an industrial scale up to the present time is that the alloying elements (Si, Mo, W, V, Cr) cause an excessive appearance of oxides, thus resulting in very unreliable bonding of the tip to its substrate and consequently in a high reject rate.

It is for this reason that industrial blades which are commercially available at the present time and have tips of high-speed steel are manufactured by brazing with copper since copper interposed between the mild steel substrate and the high-speed steel tip ensures efficient bonding after melting and cooling.

SUMMARY OF THE INVENTION

The object of the present invention is to permit industrial manufacture by roll-bonding of bars of clad steel provided with medium-alloy or high-alloy steel tips.

To this end, in accordance with the invention, the tips are formed of alloy steel obtained by powder metallurgy in their as-compacted form.

The invention in fact consists in making use of the gangue of mild steel which entirely covers the sintered steel ingots after compacting and forms a layer which is subsequently bonded to the mild steel of the substrate and of the counter-tip.

The manufacture of steels and alloys by powder metallurgy is a well-known process which consists in spraying molten metal in extremely small droplets which are cooled in the form of powder made up of microscopic spherules. The bars of alloy are obtained by compacting mild steel capsules containing the alloy powder, the compacting operation being carried out at very high pressure. The small ingots thus obtained are constituted by a sintered steel core to which is intimately bonded a surface gangue of mild steel formed by the capsule which contained the powder prior to compacting. The small ingots are then rolled into bars. These bars are subsequently machined in order to free them from their gangue of mild steel.

On the contrary, in the method according to the invention, the gangue just mentioned is retained since it is not liable at the time of roll-bonding to cause oxides to appear in proportions which would prove detrimental to bonding of the tip to its substrate.

BRIEF DESCRIPTION OF THE DRAWINGS

In the following description, consideration will be given solely by way of example to one application of the method to the manufacture of a guillotine-cutter blade, reference being made to the accompanying drawings, in which.

DETAILED DESCRIPTION OF THE INVENTION

Figure 1:
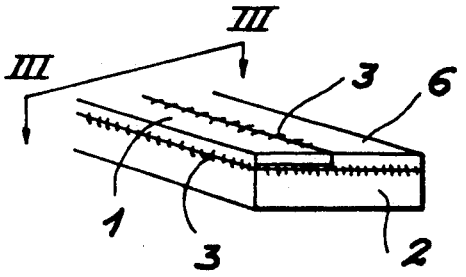
FIG. 1 is a schematic view in perspective showing a bar of mild steel attached to a tip of sintered high-speed steel and a counter-tip of mild steel.

FIG. 1 illustrates the first step in the manufacture of the guillotine-cutter blade. The tip 1 of sintered high-speed steel provided with its compacting gangue of mild steel is mounted on its mild steel substrate 2 by means of a weld fillet 3. The tip 1 is adjacent to a counter-tip 6 of mild steel which is also rigidly fixed to the substrate 2 by means of a weld fillet 3. The intended function of this roughly-formed welded assembly is to hold the parts 1, 2 and 3 in position during the roll-bonding operation and to prevent as far as possible any oxidation of the surfaces in contact during heating to approximately 1100°–1150° C. which immediately precedes the roll-bonding operation, whilst the weld fillets 3 perform the function of sealing beads.

Figure 2:
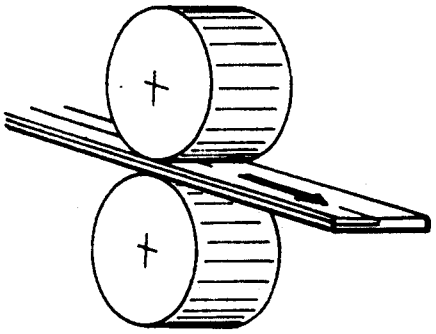
FIG. 2 is a schematic view in perspective illustrating the roll-bonding operation.

The roll-bonding operation illustrated diagrammatically in FIG. 2 is then performed. During this operation, the block formed as shown in FIG. 1 and preheated is passed at least once and preferably a number of times through a rolling mill in order to obtain a rate of reduction per drawing pass of approximately 4 to 5.

As mentioned earlier, by reason of the fact that the tip 1 is formed from a bar of sintered steel which has retained its gangue of mild steel, the quality of the forging obtained will ensure a very good physico-chemical bond between the tip 1, the counter-tip 6 and the substrate 2.

Figure 3:
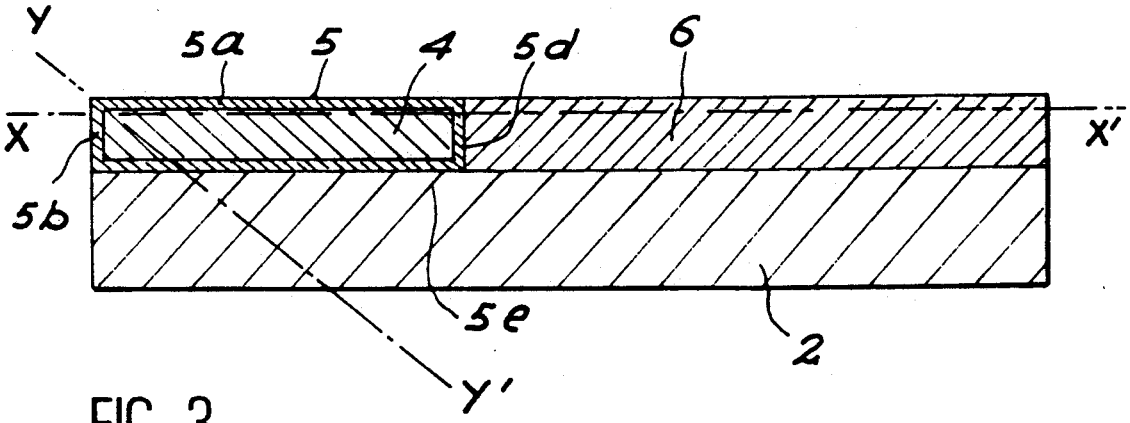
FIG. 3 is a schematic view in cross-section to a larger scale, this view being taken along line III—III of FIG. 1.

As shown in cross-section in FIG. 3, the sintered high-speed steel core 4 of the tip 1 is perfectly surrounded by its gangue 5 of mild steel. The roll-bonding operation has had the effect of forcibly applying said tip and its counter-tip 6 on the substrate 2, thus forming an intimate bond between the three parts.

Figure 4:
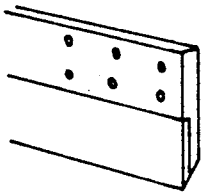
FIG. 4 is a fragmentary view in perspective showing a guillotine-cutter blade obtained by the method in accordance with the invention.

In order to obtain the end product, namely the cutter blade shown in FIG. 4, the bar is then heat-treated and machined. By milling and grinding along lines X—X and Y—Y, the portions 5*a* and 5*b* of the gangue are removed. Sharpening of the sintered high-speed steel core thus freed has the effect of forming the cutting edge of the blade. After annealing, the holes and/or slots for fixing the tool 1 are formed by drilling and/or milling in the mild-steel portion, namely the counter-tip and the substrate, since this portion is not annealed.

The fact that the invention permits the use of the roll-bonding process for medium-alloy or high-alloy steel makes it possible to keep the end products at a competitive price level in comparison with the products at present obtained by brazing, despite the extra cost resulting from the use of sintered steel. In addition, the quality of the tools obtained by making use of sintered steel is appreciably higher than the quality of tools at present proposed on the market.

The invention is clearly not limited to the manufacture of guillotine-cutter blades as described in the foregoing but includes any bar of clad steel/alloy obtained by roll-bonding of a tip of sintered alloy which has retained its gangue of mild steel and also includes any tool manufactured from a bar of this type.

What is claimed is:

1. A method of manufacturing a roll-bonded bar, comprising producing a tip of medium-alloy or high-alloy steel powder contained within a surface envelope of mild steel, sintering said enveloped tip, securing said enveloped tip to a substrate of mild steel by weld fillets that extend along and seal between the enveloped tip and the mild steel substrate, heating the structure thus produced, and passing the structure thus produced through a rolling mill in order to subject the structure simultaneously to forcible application of the tip to the substrate and to mechanical working of the composite assembly, said weld fillets sealing the surfaces between the tip and the substrate to reduce oxidation of said surfaces.

2. A method as claimed in claim 1, wherein said medium-alloy or high-alloy steel is composed of more than 2% of alloying elements.

3. A method as claimed in claim 2, wherein said medium-alloy or high-alloy steel is of a grade designated as Z160CDV12.

4. A method as claimed in claim 2, wherein said medium-alloy or high-alloy steel is high-speed steel of the type 18-0-1 or 6-5-2.

5. A method as claimed in claim 1, and juxtaposing a counter-tip to the first-mentioned tip on said substrate and rigidly fixing said counter-tip to said substrate as well as to said first-mentioned tip by means of weld fillets.

6. A roll-bonded bar produced by the method of claim 1.

* * * * *